US008464800B2

(12) United States Patent
Nutley et al.

(10) Patent No.: US 8,464,800 B2
(45) Date of Patent: Jun. 18, 2013

(54) EXPANDABLE MEMBER FOR DOWNHOLE TOOL

(75) Inventors: Kim Nutley, Inverurie (GB); Brian Nutley, Aberdeen (GB)

(73) Assignee: Swelltec Limited, Dyce, Aberdeen (GB)

( * ) Notice: Subject to any disclaimer, the term of this patent is extended or adjusted under 35 U.S.C. 154(b) by 184 days.

(21) Appl. No.: 12/393,960

(22) Filed: Feb. 26, 2009

(65) Prior Publication Data

US 2009/0211767 A1 Aug. 27, 2009

(30) Foreign Application Priority Data

Feb. 27, 2008 (GB) ..... 0803555.2

(51) Int. Cl.
*E21B 33/12* (2006.01)

(52) U.S. Cl.
USPC ..... 166/387; 166/195; 166/196

(58) Field of Classification Search
USPC ..... 166/179, 180, 195, 196, 387
See application file for complete search history.

(56) References Cited

U.S. PATENT DOCUMENTS

| | | | | |
|---|---|---|---|---|
| 2,144,026 | A * | 1/1939 | Park | 277/340 |
| 4,137,970 | A * | 2/1979 | Laflin et al. | 166/292 |
| 4,865,127 | A * | 9/1989 | Koster | 166/277 |
| 7,143,832 | B2 * | 12/2006 | Freyer | 166/387 |
| 7,472,757 | B2 * | 1/2009 | Freyer | 166/387 |
| 7,510,015 | B2 * | 3/2009 | Corre et al. | 166/387 |
| 7,665,537 | B2 * | 2/2010 | Patel et al. | 166/387 |
| 7,681,653 | B2 * | 3/2010 | Korte et al. | 166/387 |
| 7,762,344 | B2 * | 7/2010 | Courville et al. | 166/387 |
| 2005/0199401 | A1 * | 9/2005 | Patel et al. | 166/387 |
| 2007/0151723 | A1 * | 7/2007 | Freyer | 166/179 |
| 2007/0193736 | A1 * | 8/2007 | Corre et al. | 166/187 |
| 2008/0078561 | A1 * | 4/2008 | Chalker et al. | 166/387 |
| 2008/0093086 | A1 * | 4/2008 | Courville et al. | 166/378 |
| 2009/0139708 | A1 * | 6/2009 | Foster | 166/118 |
| 2009/0211767 | A1 * | 8/2009 | Nutley et al. | 166/378 |
| 2009/0211770 | A1 * | 8/2009 | Nutley et al. | 166/387 |
| 2010/0025035 | A1 * | 2/2010 | Korte et al. | 166/272.1 |
| 2010/0038076 | A1 * | 2/2010 | Spray et al. | 166/207 |
| 2010/0051295 | A1 * | 3/2010 | Courville et al. | 166/387 |
| 2010/0147508 | A1 * | 6/2010 | Foster | 166/118 |
| 2010/0230902 | A1 * | 9/2010 | Castillo et al. | 277/331 |
| 2010/0314134 | A1 * | 12/2010 | Nutley et al. | 166/387 |
| 2011/0056706 | A1 * | 3/2011 | Brooks | 166/387 |

FOREIGN PATENT DOCUMENTS

| | | | |
|---|---|---|---|
| GB | 2472328 | A * | 2/2011 |
| WO | WO 2008051250 | A2 * | 5/2008 |

* cited by examiner

*Primary Examiner* — Jennifer H Gay
(74) *Attorney, Agent, or Firm* — Wong, Cabello, Lutsch, Rutherford & Brucculeri, LLP

(57) ABSTRACT

A method of forming a downhole apparatus comprises the steps of providing a body having a longitudinal axis and forming an expanding portion on the body from multiple layers of a partially or substantially cured material around the longitudinal axis of the body. The material is selected to increase in volume on exposure to at least one predetermined fluid, such as a wellbore fluid. Apparatuses formed by the method include wellbore packers.

35 Claims, 6 Drawing Sheets

EXPANDABLE MEMBER FOR DOWNHOLE TOOL

FIELD OF THE INVENTION

The present invention relates to a method for forming an apparatus for use downhole or in pipelines, in particular in the field of oil and gas exploration and production, and an apparatus formed by the method.

BACKGROUND

This application claims the benefit of United Kingdom Patent Application No. GB0803555.2, filed on Feb. 27, 2008, which hereby is incorporated by reference in its entirety.

In the field of oil and gas exploration and production, various tools are used to provide a fluid seal between two components in a wellbore. Isolation tools have been designed for sealing an annulus between two downhole components to prevent undesirable flow of wellbore fluids in the annulus. For example, a packer may be formed on the outer surface of a completion string which is run into an outer casing or an uncased hole. The packer is run with the string to a downhole location, and is inflated or expanded into contact with the inner surface of the outer casing or openhole to create a seal in the annulus. To provide an effective seal, fluid must be prevented from passing through the space or micro-annulus between the packer and the completion, as well as between the packer and the outer casing or openhole.

Isolation tools are not exclusively run on completion strings. For example, in some applications they form a seal between a mandrel which forms part of a specialised tool and an outer surface. In other applications they may be run on coiled tubing, wireline and slickline tools.

Conventional packers are actuated by mechanical or hydraulic systems. More recently, packers have been developed which include a mantle of swellable elastomeric material formed around a tubular body. The swellable elastomer is selected to expand on exposure to at least one predetermined fluid, which may be a hydrocarbon fluid or an aqueous fluid. The packer may be run to a downhole location in its unexpanded state, where it is exposed to a wellbore fluid and caused to expand. The design, dimensions, and swelling characteristics are selected such that the swellable mantle expands to create a fluid seal in the annulus, thereby isolating one wellbore section from another. Swellable packers have several advantages over conventional packers, including passive actuation, simplicity of construction, and robustness in long term isolation applications. Examples of swellable packers are described in GB 2411918.

FIG. 1 of the drawings shows a swellable packer according to the prior art, generally depicted at 10, formed on a tubular body 12 having a longitudinal axis L. The packer 10 comprises an expanding mantle 14 of cylindrical form located around the body 12. The expanding mantle 14 is formed from a material selected to expand on exposure to at least one predetermined fluid. Such materials are known in the art, for example from GB 2411918.

As illustrated in FIGS. 2A and 2B, the dimensions of the packer 10 and the characteristics of the swellable material of the expanding portion 14 are selected such that the expanding portion forms a seal in use, which substantially prevents the flow of fluids past the body 12. FIG. 2A is a cross section through the packer 10 located in a wellbore 20 in a formation 22. On exposure to a wellbore fluid in the annulus 24, in this case a hydrocarbon fluid, the expanding portion 14 expands and its outer diameter increases until it contacts the surface 26 of the wellbore to create a seal in the annulus 24. The seal prevents flow of fluid in the wellbore annulus between a volume above the packer 10 and a volume below the packer 10. Although shown here in use in an uncased hole, the packer 10 could of course be used in a cased hole, in which case the mantle would form a seal against the interior surface of the outer casing.

Typically a packer will be constructed for a specific application and incorporated into a casing string or other tool string by means of threaded couplings. Swellable packers are typically constructed from multiple layers of uncured elastomeric material, such as ethylene propylene diene M-class (EPDM) rubber. Multiple layers are overlaid on a mandrel or tubular in an uncured form to build up a mantle of the required dimensions. The mantle is subsequently cured, e.g. by heat curing or air curing. The outer surface of the swellable mantle is then machined using a lathe to create a smooth cylindrical surface. This method produces a fully cured, unitary swellable mantle capable of sealing large differential pressures. However, the process is generally labour-intensive and time consuming, and the uncured material can be difficult to handle. Moreover, the resulting expanding portion, although robust and capable of withstanding high pressures, may be ill-suited to some downhole applications.

There is generally a need to provide sealing mechanisms and isolation tools and systems which may be manufactured and assembled more efficiently than in the case of the prior art, and which are flexible in their application to a variety of wellbore scenarios.

SUMMARY OF INVENTION

It is amongst the aims and objects of the invention to provide a method of forming a downhole apparatus which overcomes or mitigates the drawbacks and disadvantages of prior art methods. It is a further aim of the invention to provide an improved downhole apparatus.

According to a first aspect of the invention there is provided a method of forming an apparatus for use downhole, the method comprising the steps of:

(a) providing a body having a longitudinal axis;

(b) forming an expanding portion on the body from multiple turns of a substantially cured material around the longitudinal axis of the body, the material selected to expand on exposure to at least one predetermined fluid.

The method may comprise the step of bonding the substantially cured material on the body, and/or may comprise the step of mechanically attaching the expanding portion to the body.

The expanding portion may be formed from a continuous length of the substantially cured material.

The method may comprise the steps of forming a base layer on the on body, and forming the expanding portion on the base layer.

The method may comprise the further step of providing an outer sheath on the expanding portion.

The method may comprise the step of treating the material prior to forming the expanding portion. The material may be treated by applying a coating or layer. Alternatively, the material may be treated by perforating the material.

The method may include the step of deploying the material from a storage reel.

The method may include the additional step of further curing the material subsequent to forming the expanding portion.

According to a second aspect of the invention there is an apparatus for use downhole, the apparatus comprising: a body having a longitudinal axis; an expanding portion formed on the body from multiple turns of a substantially cured material around the longitudinal axis of the body, the material selected to expand on exposure to at least one predetermined fluid.

The apparatus may have an expanded condition in which an annular seal is formed between the body and a surface external to the body. The surface may be the internal surface of a casing or an uncased borehole. The downhole apparatus may therefore form an annular seal in the wellbore annulus, which may substantially prevent fluid flow past the body.

The downhole apparatus may be a wellbore packer and may form a part of an isolation tool or an isolation system for sealing one region of the annulus above the apparatus from another region of the annulus below the apparatus.

The terms "upper", "lower", "above", "below", "up" and "down" are used herein to indicate relative positions in the wellbore. The invention also has applications in wells that are deviated or horizontal, and when these terms are applied to such wells they may indicate "left", "right" or other relative positions in the context of the orientation of the well.

The body may be a substantially cylindrical body, and may be a tubular or a mandrel. The substantially cured material may extend circumferentially around the body. The substantially cured material may be a sheet material, and may be flexible.

The material may be substantially cured such that its mechanical properties and/or handling characteristics are similar to those of a fully cured material. The material is preferably an elastomer, which is preferably in its T80 state or above, where T100 is a fully cured elastomer. The material may be in its T90 state or above. The expanding material may be formed in a continuous length of several tens of metres.

According to one embodiment, the material is an elastomer cured to a T50 state or above.

The substantially cured material may comprise a material selected to expand on exposure to a hydrocarbon fluid, which may be an EPDM rubber. Alternatively, or in addition, the substantially cured material may comprise a material selected to expand on exposure to an aqueous fluid, which may be a super-absorbent polymer.

The substantially cured material may be formed by an extrusion process, which may be a co-extrusion of two or more materials. The two materials may both be selected to expand on exposure to at least one predetermined fluid, but may be selected to differ in one or more of the following characteristics: fluid penetration, fluid absorption, swelling coefficient, swelling rate, elongation coefficient, hardness, resilience, elasticity, and density. At least one material may comprise a foam. The material may be foamed through the addition of blowing agents. In some applications this will aid fluid absorption leading to faster swell rates and higher maximum swell volumes. Alternatively, or in addition, the substantially cured material may be formed from an extrusion around a substrate.

The substantially cured material may comprise a substantially rectangular cross sectional profile. Alternatively, or in addition, the substantially cured material may comprise an interlocking profile, which may be configured for interlocking multiple layers of the material on the body. The interlocking profile may resist axial separation of adjacent layers, and/or may resist relative slipping of adjacent turns. A bonding agent may be used to secure a first side of the substantially cured material to the shape of the second, opposing side of the substantially cured material. Where an interlocking profile is provided, the material may be further locked in position through the use of an adhesive or other bonding agent.

The apparatus may further comprise means for securing the substantially cured material to the body, which may comprise a bonding agent. Alternatively, or in addition, the apparatus may comprise a mechanical attachment means for securing the substantially cured material to the body, which is preferably an end ring. The mechanical attachment means may be clamped onto the body, and may comprise a plurality of hinged clamping members. Alternatively, mechanical attachment means is configured to be slipped onto the body.

In one embodiment, the mechanical attachment means is configured to be disposed on a coupling of a tubular, and may be referred to as a cross-coupling mechanical attachment means.

The apparatus may be configured as a cable encapsulation assembly, and may comprise a support element disposed between the body and the substantially cured material. The support element may be provided with a profile configured to receive a cable, conduit or other line. The support element may comprise a curved outer profile, and the assembly may define an elliptic outer profile. Alternatively the support element may comprise a substantially circular profile such that the assembly defines a circular outer profile.

In one embodiment, the substantially cured material is subjected to processing steps due to its improved handling and storage characteristics when compared to uncured or semi-cured materials. The substantially cured material may comprise a coating. Alternatively, or in addition, the substantially cured material may comprise perforations. Preferably, the perforations are formed to provide a pathway for an activating fluid.

According to a third aspect of the invention there is provided a method of forming a seal in a wellbore annulus using the apparatus of the second aspect of the invention.

According to a fourth aspect of the invention there is provided a method of forming an apparatus for use downhole, the method comprising the steps of:

(a) providing a body having a longitudinal axis;

(b) forming an expanding portion on the body from multiple turns of a partially cured material around the longitudinal axis of the body, the material selected to expand on exposure to at least one predetermined fluid.

The method may include the additional step of further curing the material subsequent to forming the expanding portion.

According to a fifth aspect of the invention there is provided an apparatus for use downhole, the apparatus comprising: a body having a longitudinal axis; an expanding portion formed on the body from multiple turns of a partially cured material around the longitudinal axis of the body, the material selected to expand on exposure to at least one predetermined fluid.

In preferred embodiments of the fourth and/or fifth aspects of the invention, the material may be partially cured such that it is in a cured state in the range of T30 to T50.

Embodiments of the fourth and fifth aspects of the invention may comprise preferred and optional features of the first and second aspects of the invention and its embodiments. Combinations of features other than those explicitly stated herein form a part of the invention.

DETAILED DESCRIPTION

Figure 1:
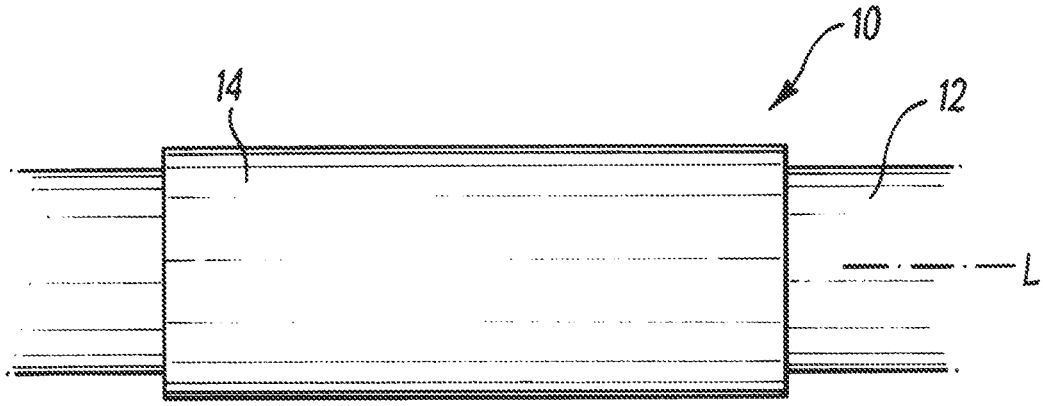
FIG. 1 (Prior Art)
FIG. 1 is a side view of a prior art wellbore packer.
Figure 2A:
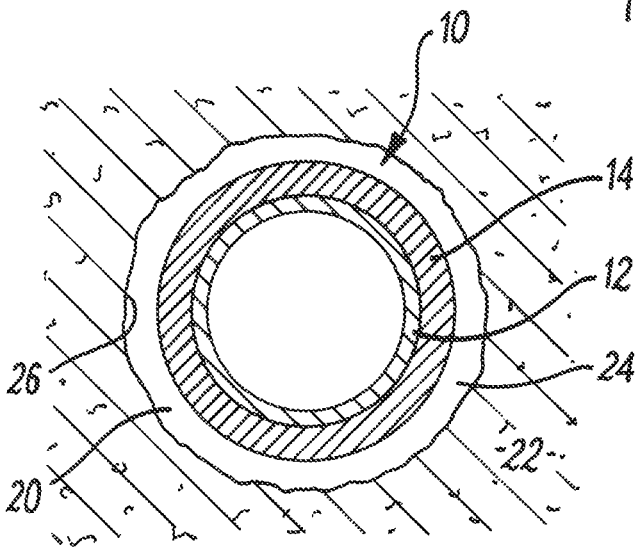
FIG. 2A (Prior Art)
FIGS. 2A and 2B are schematic cross sectional views of a prior art wellbore packer in use in unexpanded and expanded conditions respectively.
Figure 2B:
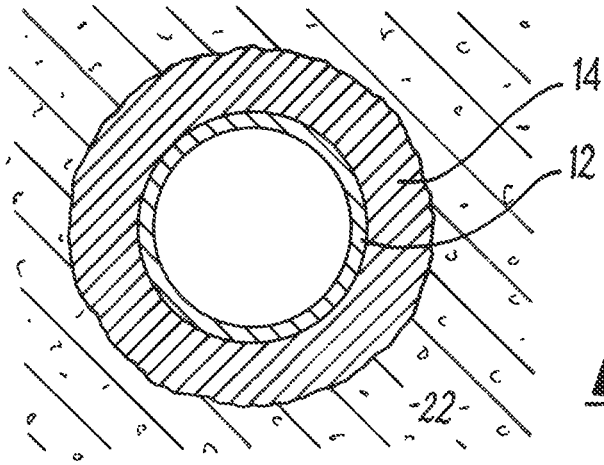
FIG. 2B (Prior Art)
Figure 3:
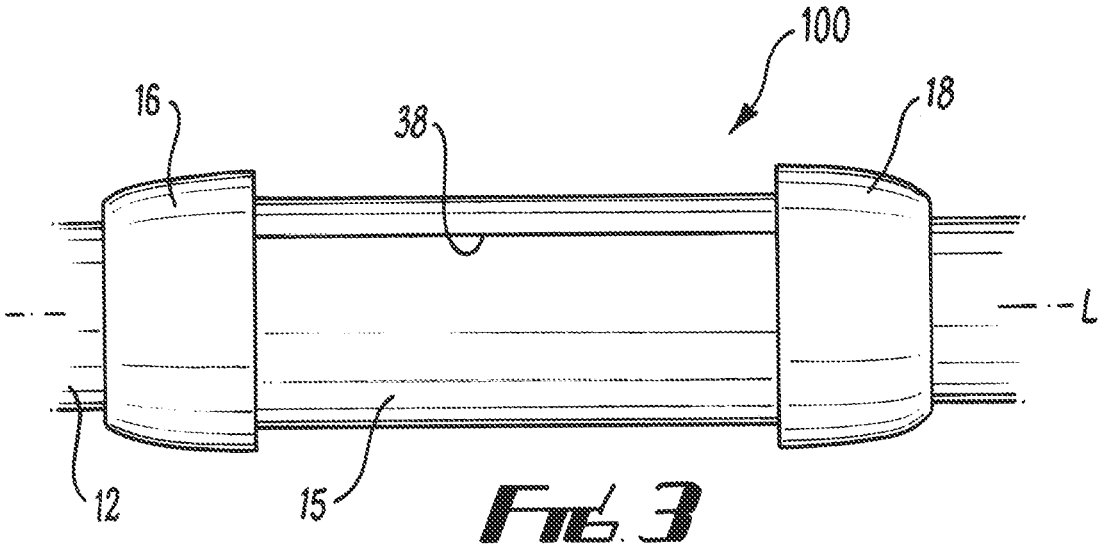
FIG. 3 is a side view of a packer in accordance with an embodiment of the invention.

Referring to FIG. 3 of the drawings, there is shown schematically an aspect of the invention embodied as a wellbore packer, generally depicted at 100, formed on a tubular body 12 having a longitudinal axis L. The packer 100 comprises an expanding portion 15 of cylindrical form located around the body 12 and a pair of end rings 16, 18 located respectively at opposing ends of the expanding portion 15. The expanding portion 15 is formed from a material selected to expand on exposure to at least one predetermined fluid. In this embodiment, the swellable material is EPDM, selected to expand on exposure to a hydrocarbon fluid. The functions of the end rings 16, 18 include providing stand-off and protection to the packer 100 and the tubular 12, axially retaining the expanding portion 15, and mitigating extrusion of the expanding portion 15 in use. The operation of the packer 100 can be understood from FIGS. 2A and 2B and the accompanying text.

Figure 4:
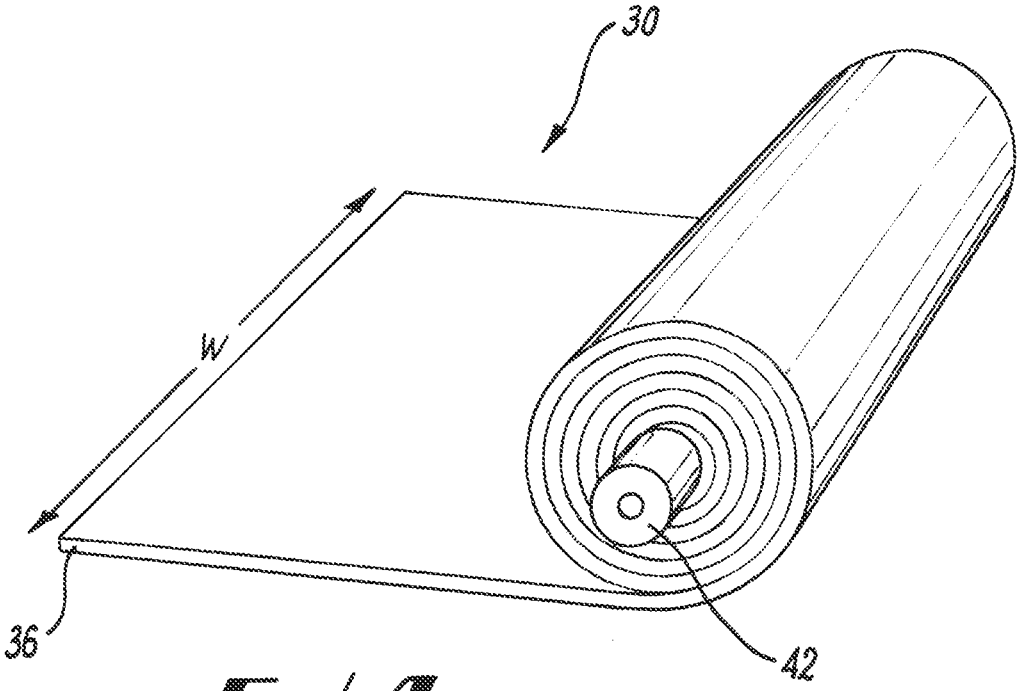
FIG. 4 is a perspective view of an expanding material in accordance with an embodiment of the invention.

FIG. 4 of the drawings shows an expanding material 30 used to form packer 100. The expanding material 30 consists of a substantially rectangular sheet which is used to form the expanding portion 15, and is shown here partially unrolled from a storage reel 42. In this example, the expanding material 30 is extruded EPDM and is substantially fully cured, exhibiting similar mechanical properties and handling characteristics to a fully cured elastomer. The curing state of an elastomer can be conveniently indicated using a scale, based on torque measurements of viscosity with time. The measurements may be taken, for example, using an oscillating rheometer.

The maximum value of torque measured during a viscosity test, $torque_{max}$, occurs when the elastomer is fully cured, and $torque_{min}$ is the lowest recorded value of viscosity during the test. The curing time taken for the elastomer to reach $torque_{max}$ is T100, and represents the time required to fully cure (i.e. 100% cure) the elastomer. Intermediate curing states can be indicated by curing times T1, T2, T50, T80, T90 etc, where Tx is the curing time when the torque value is:

$$(torque_{max}-torque_{min})*x/100+torque_{min}$$

In other words, T90 is the time at a point when the measured torque is equal to the minimum torque plus 90% of the difference between the maximum torque and the minimum torque. An elastomer that is cured for a time equal to T90 is said to be in a T90 cured state. (In an alternative notation, P80, P90, P100 etc. may be used to represent the T80, T90 and T100 curing states).

An elastomer in its T90 state or above may be referred to as substantially fully cured. The expanding material will typically be formed in a continuous length of several tens of metres.

Figure 5A:
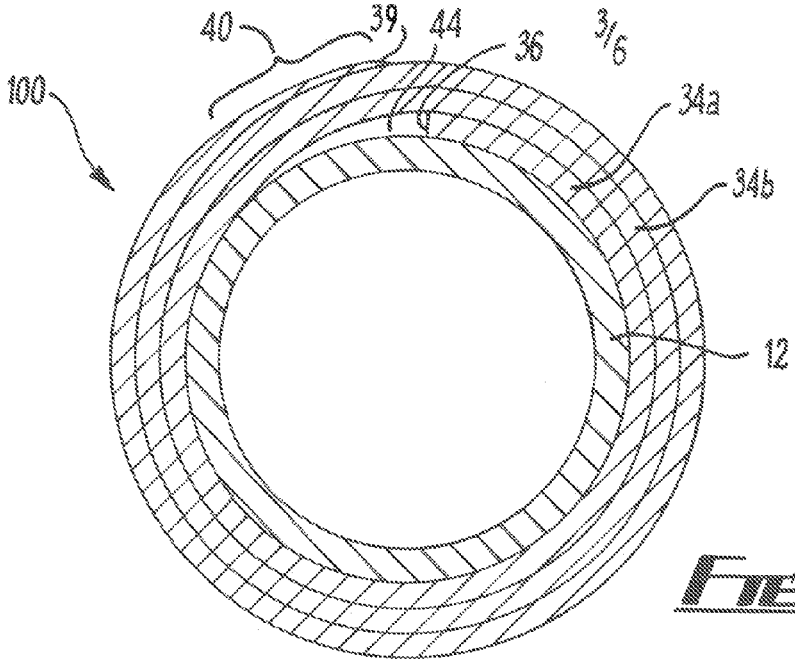
FIG. 5A is a cross sectional view of the packer of FIG. 3 in an unexpanded condition.

FIG. 5A shows the packer 100 in cross section in an unexpanded state. The packer 100 is formed from the expanding material 30, by forming multiple wraps 34*a*, 34*b* on the tubular 12. The first end 36 of the expanding material is located on the outer surface of the tubular 12, with the edge oriented substantially in the longitudinal direction of the tubular 12. The lower surface 38 of the expanding material 30 is secured to the tubular 12 by a bonding agent. In this embodiment, the bonding agent used is a cyanoacrylate-based adhesive, but other bonding agents are suitable, including polyurethane-based adhesives, acrylic-based adhesives, epoxy-based adhesives or silicone-based adhesives or sealants.

Figure 5B:
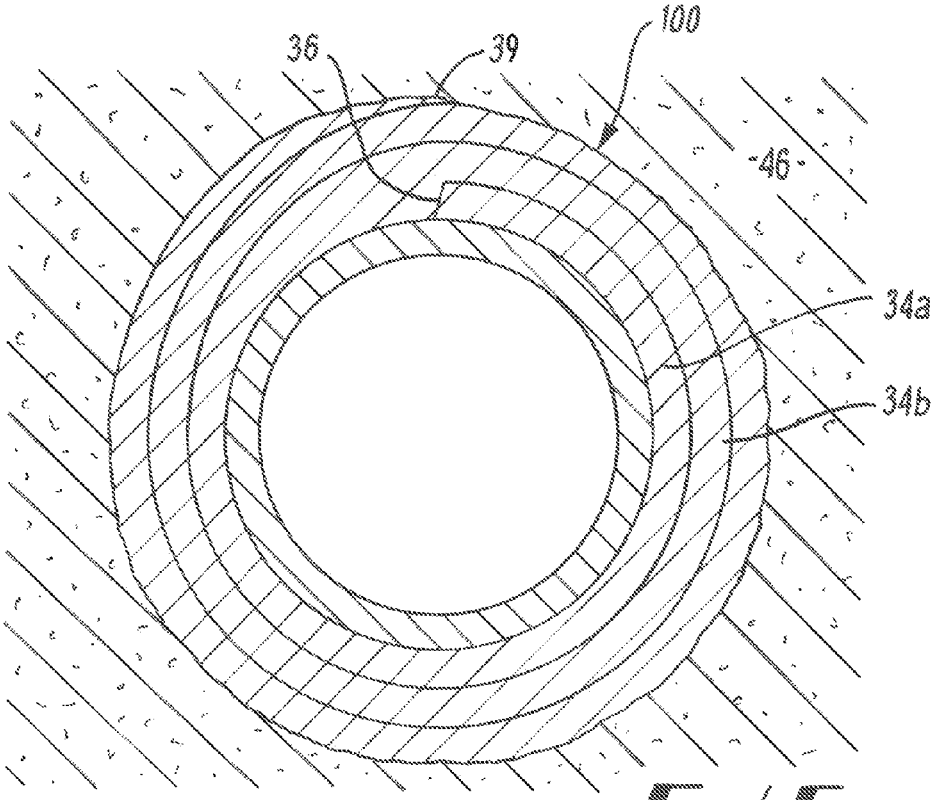
FIG. 5B is a cross sectional view of the packer of FIG. 3 in an expanded condition.

The expanding material 30 is further deployed from the storage reel 42 and is wrapped around the tubular body 12 and bonded to its outer surface, as shown in FIG. 5B deployed in a formation 46, and is applied such that the multiple layers are overlaid with one another. Tension is applied to the expanding material 30 during winding. Tension allows a seal to be created between the expanding material and the body even when the expanding material is in its unexpanded condition. To facilitate the application of the expanding material 30 to the body and maintaining tension, the expanding material may be temporarily secured to the body at its first end by a clamp (not shown). The expanding material 30 in this example is formed to a width W corresponding to the desired length of the packer 100, which is selected according to the application and pressure conditions it is required to withstand. The expanding material 30 is cut to define second end 39, which is bonded to the layer of the expanding material upon which it lies. In another embodiment the entire surface between multiple layers is bonded. The outer surface 40 of the expanding material 30 adjacent the end 39 is shaped to reduce or remove the shoulder which would otherwise be defined by the edge 39.

First and second rings 16, 18 are subsequently located over the first and second ends of the expanding portion and secured to the body 12 by means of threaded bolts (not shown), with the completed tool shown in FIG. 3. The end rings have an internal profile to accommodate the raised (with respect to the tubular body 12) profile of the expanding portion 15. In this embodiment, the end rings 16 and 18 are formed in two hinged parts (not shown), which are placed around the expanding portion 15 and the tubular 12 from a position adjacent to the apparatus, and fixed together using locking bolts (not shown). In alternative embodiments, the end rings are unitary structures slipped onto the tubular 12 from one end. In a further embodiment, the end rings may clamp over a fixed upset profile on the body 12, such as a tubing or casing coupling. Such an embodiment may be particularly advantageous where an expanding portion is required over the entire length of a tubular between couplings, and may provide an improved anchoring force for the end ring and the expanding material. In a further alternative embodiment, end rings may not be required.

The dimensions of the packer 100 and the characteristics of the swellable material of the expanding material 30 are selected such that the expanding portion forms a seal in use, which substantially prevents the flow of fluids past the body 12. The packer operates in the manner described with reference to FIGS. 2A and 2B. The edge 36 defines a shoulder which creates a space 44 between the layer 34*b* and the tubular 12 in its unexpanded condition shown in FIG. 5A. FIG. 5B shows the packer 100 in an expanded condition in an uncased hole in a formation 46. The expanding portion has been exposed to wellbore fluid and has expanded into contact with the wall of the uncased hole to create a seal in the annulus. The edge 36 and the layer 34*a* expand into the space 44 such that the seal is complete.

The expanding portion 15 thus resembles a swellable mantle as used in conventional swelling packers, but offers several advantages and benefits when compared with conventional packer designs. For example, the expanding material 30 is economical to manufacture, compact to store, and easy to handle when compared with the materials used in conventional swellable packers.

The process of forming the packer offers several advantages. Firstly, the process does not require specialised equipment requiring large amounts of space or capital expenditure. The process can be carried out from a central portion of the tubular body, by attaching a first end of the expanding material and wrapping it around the tubular, reducing the difficulties associated with slipping tool elements on at an end of the tubular and sliding them to the required location. This facilitates application of the expanding material to significantly longer tubulars, and opens up the possibility of constructed packer on strings of tubing on the rig floor immediately prior to or during assembly.

By using a substantially cured expanding material, ease of storage and handling of the material is improved compared with prior art methods in which a semi-cured material is wrapped on a body. The method also avoids the requirement for curing step subsequent to the application of the expanding material on the body. It should be noted however that the expanding material 30 may be further cured, for example from a P90 state to a P100 state, after application to the tubular.

The construction process allows for a high degree of flexibility in tool design. For example, a packer of any desired outer diameter can be created from the same set of components, simply by adjusting the number of layers over which the expanding material is wrapped on the tubular body. Packers and seals can be created on bodies and tubulars of a range of diameters. The principles of the invention also inherently allow for engineering tolerances in the dimensions of bodies on which the seal is created.

The resulting packer has increased surface area with respect to an equivalent packer with an annular mantle, by virtue of the increased penetration of the fluids into the expanding portion via the small spaces between multiple layers. This allows for faster expansion to the sealing condition. The expanding material also lends itself well to post-processing, for example perforating, coating or performing analysis on a sample.

Figure 6:
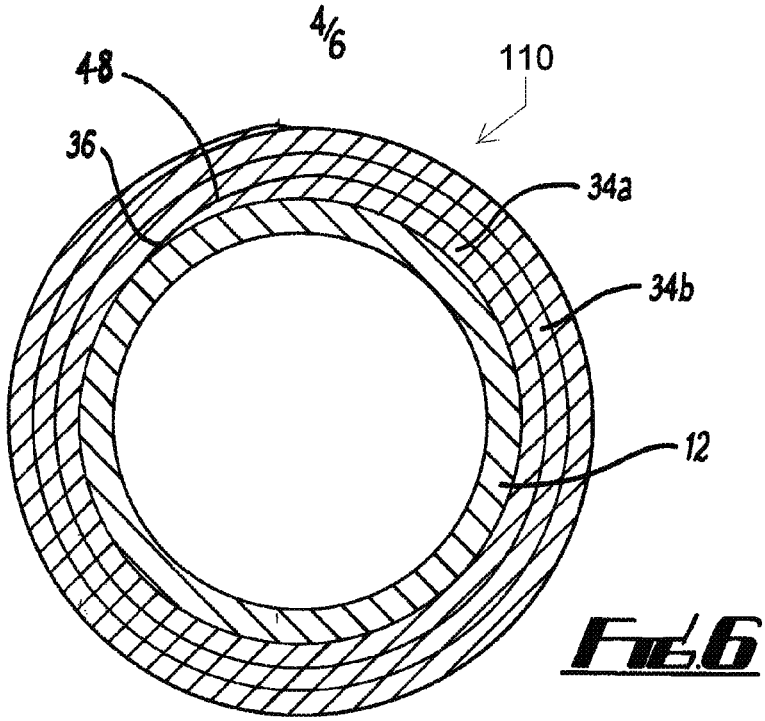
FIG. 6 is a cross sectional view of a packer in accordance with an alternative embodiment of the invention.

FIG. 6 shows in cross-section a packer 110 in accordance with an alternative embodiment of the invention, similar to the packer 100 with like parts indicated by like reference numerals. The packer 110 differs from the packer 100 in that the outer surface 48 of the layer 34*a* of expanding material 30 adjacent the end 36 is shaped to reduce or remove the shoulder which would otherwise be defined by the edge 36.

Figure 7:
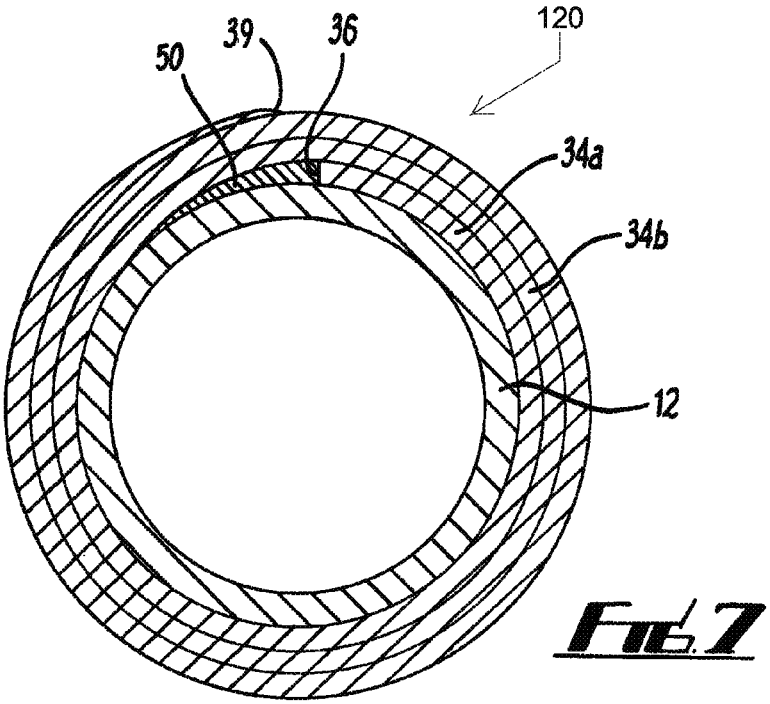
FIG. 7 is a cross sectional view of a packer in accordance with a further alternative embodiment of the invention.

FIG. 7 shows in cross section a packer 120 in accordance with an alternative embodiment of the invention, similar to the packer 100 with like parts indicated by like reference numerals. The packer 120 differs from the packer 100 in that it comprises a support element 50, which could be made from swellable elastomer, plastic or metal, comprises a part-circular inner profile and a curved outer surface. The support element abuts the end 36 of the expanding material 30, and provides a substantially smooth path for the material 30 from the surface of the tubular 12 to the shoulder defined by the edge 36 and the outer surface of the layer 34*a*. This avoids the creation of the space 44 of the packer 100. In an alternative embodiment, the support element comprises a profile or opening configured to receive a cable or conduit, which allows a cable or conduit to pass through the apparatus.

Figure 8:
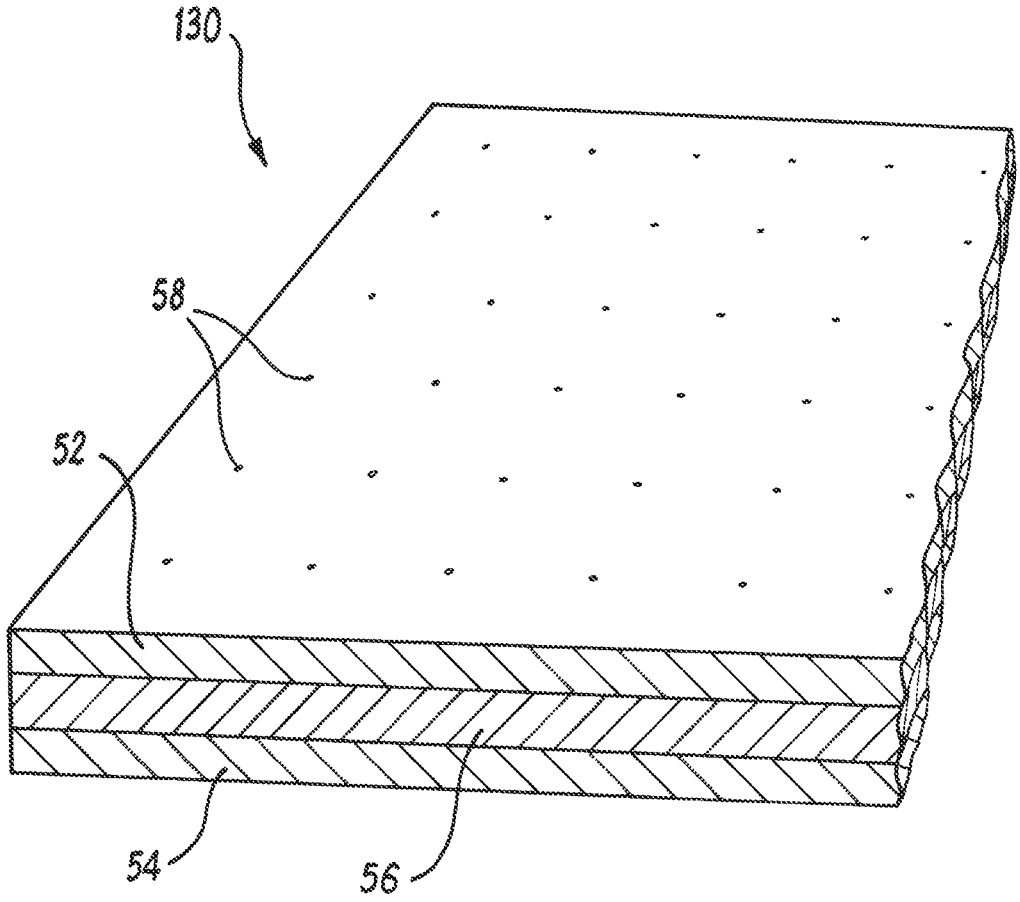
FIG. 8 is a perspective view of an expanding material in accordance with an alternative embodiment of the invention.

FIG. 8 shows in cross section an expanding portion 130 in accordance with an alternative embodiment of the invention. Expanding material 130 is similar to the expanding material 30 of FIG. 4, but differs in that it is co-extruded from two different materials to create a sheet having different material components. The material 130 has outer layers 52, 54 of a first material and an inner layer 56 of a second material. Suitable manufacturing techniques would be known to one skilled in the art of extrusion and co extrusion of polymers and elastomers.

The outer layers 52, 54 are of an EPDM rubber selected to expand on exposure to a hydrocarbon fluid, and having specified hardness, fluid penetration, and swelling characteristics suitable for downhole applications. The inner layer 56 is an EPDM rubber which has a greater degree of cross-linking between molecules, compared with the material of the outer layers, and correspondingly has greater hardness, lower fluid penetration, and lower swelling characteristics than the outer layer. The inner layer 56 also has a greater mechanical strength, and functions to increase the strength of the material as a whole when compared with material 30. This allows more tension to be applied and retained in the expanding material during the construction process, and reduces any tendency of the expanding portion to swage.

The outer layers of the expanding material 130 are provided with apertures or perforations 58. This increases the surface area of the expanding portion formed, and provides for greater exposure of the expanding member to wellbore fluids.

The substantially cured material may conveniently be subjected to processing steps due to its improved handling and storage characteristics when compared to uncured or semi-cured materials. For example, the perforations 58 may be formed by feeding the material 130 through a perforating drum or laser perforating equipment. The perforated material may be conveniently stored on a storage reel. In alternative embodiments, the material 130 or 30 may be treated with a coating, for example of a coating material impervious to at least one selected wellbore fluid. In another embodiment, the material is treated with an adhesive or bonding agent, which may be one part of a two-part adhesive. It will be appreciated that material 30 may be similarly treated and/or perforated.

In another embodiment, the density of the expanding material is changed over its cross-section to create an increased porosity-permeability structure which leads to more rapid swell rates and higher swell volumes. This may be achieved by foaming the expanding material through the addition of blowing agents. Foaming can be effected over a part of the cross section of the expanding material, to allow a greater porosity-permeability structure to be setup inside the expanding material. Co-extrusions of a foamed inner layer with an overlying solid elastomer, or vice versa, can allow hybrid expanding materials to be created having, for example with a high water swelling inner layer and an oil swelling outer mantle. In such an embodiment, it may be particularly advantageous to perforate the outer layer to provide a fluid path for water molecules to access the water swellable inner layer. The size of the perforations may be selected to restrict the passage of hydrocarbon molecules.

Figure 9:
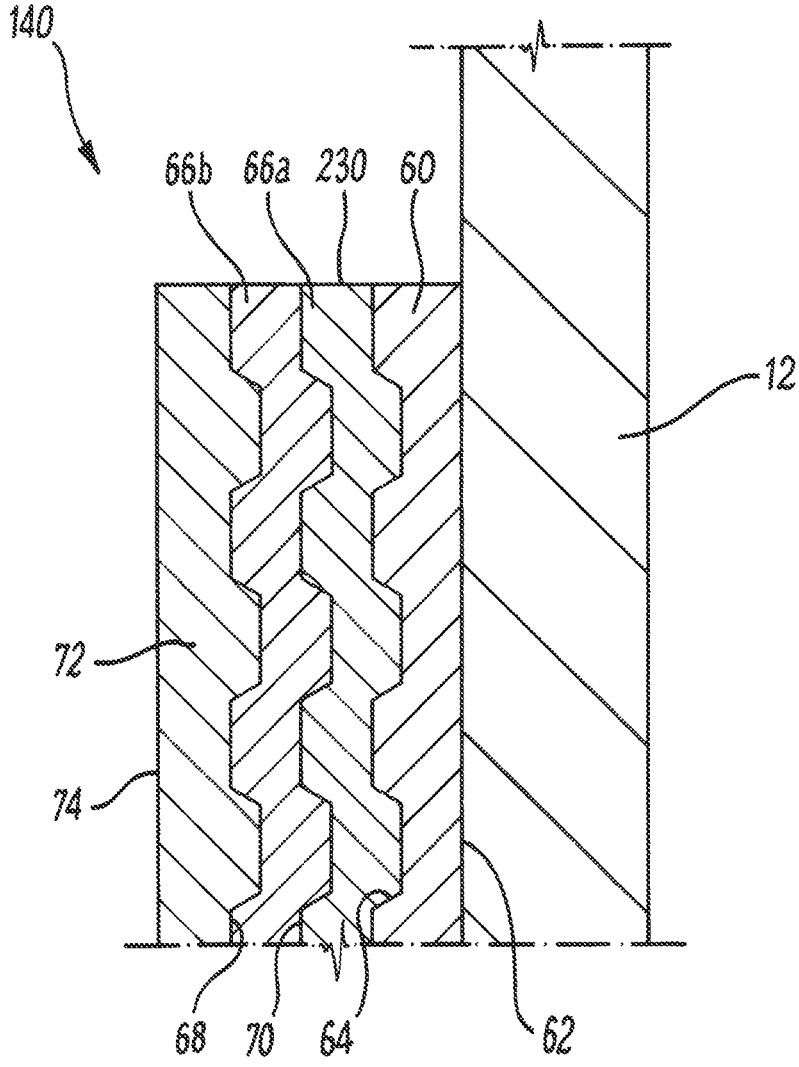
FIG. 9 is a detail of a cross sectional view of a packer according to a further alternative embodiment of the invention.

FIG. 9 shows a detail of a packer 140 in accordance with a further embodiment of the invention. In this embodiment, the packer is formed by wrapping multiple layers of an expanding material 230 on a tubular 12. A first layer 60, having a cylindrical inner surface 62 sized to fit over the tubular 12, is provided on the tubular body. In this embodiment the layer 60 is formed from a sheet of EPDM rubber wrapped around and bonded to the tubular 12 such that its opposing edges abut, but in other embodiments the layer 60 may be a plastic, metal or composite layer, and may be a cylindrical body slipped onto the tubular 12. The outer surface 64 of the layer 232 is profiled to create a series of annular ridges and grooves extending circumferentially around the layer 232.

The expanding portion of the packer 140 is formed from second and third layers 66*a*, 66*b* of expanding material 230 around the layer 60. The expanding material 230 is provided with profiled upper and lower surfaces 68, 70 which correspond to the profile of the outer surface 64 of the layer 60. The ridges created by the lower surface 70 of the layer 66*a* are received in the grooves on the surface 64 of layer 60. The ridges created by the lower surface 70 of the layer 66*b* are received in the grooves on the surface 68 of layer 66*a*. The walls of the ridges and grooves are chamfered to facilitate self-location of the layers during the wrapping process.

The outermost layer 72 is in this example formed from the expanding material 230, but has the ridges of its outer surface 74 machined off to create a substantially cylindrical outer surface. In another embodiment, the outermost layer 72 is formed from a cylindrical sheath which is slipped onto the tubular and stretched over the expanding portion of the packer to aid in retention of the constituent layers. The sheath may be perforated to provide fluid access to the expanding portion.

The interlocking profiles of the layers which make up the packer function to resist axial separation of the in use, and also increase the surface area of contact between the layers.

In alternative embodiments (not illustrated), the expanding material is extruded with a substrate, which may be a plastic material, a fibrous material or a composite material, and which may be formed using an appropriate manufacturing technique, and may be extruded, moulded, cast or woven. The substrate provides structural strength to the material, allows more tension to be imparted during application to a tubular body, binds to the swellable material, resists expansion of the expanding material in a longitudinal direction, and resists swaging of the expanding material on the tubular body.

The apparatus may be configured to encapsulate a line or conduit, which extends through the packer between two layers of the expanding material. Thus although the packer creates a seal in the annulus, there is continuous path from the region above the packer to a region below the packer, via the conduit provided in the expanding portion. The path may be a hydraulic line for the supply of hydraulic fluids. In other embodiments, this conduit can be used for the deployment of fluids, cables, fibre optics, hydraulic lines, or other control or data lines across the seal. One specific application of the invention is to artificial lift systems using electric submersible pumps (ESPs). In ESP systems it will typically be necessary to deploy a power cable from surface to the ESP, through a packer which creates an annular seal. A support element may be provided to accommodate and protect the conduit or line.

The foregoing description relates primarily to the construction of wellbore packers on tubulars. It will be appreciated by one skilled in the art that the invention is equally applicable to packers formed on other apparatus, for example mandrels or packing tools which are run on a wireline. In addition, the present invention has application to which extends beyond conventional packers. The invention may be particularly valuable when applied to couplings and joints on tubulars and mandrels. The invention can also be applied to coiled tubing, for use in coiled tubing drilling or intervention operations. Furthermore, the body need not be cylindrical, and need not have a smooth surface. In some embodiments, the body may be provided with upstanding formations or inward recesses with which an expanding material cooperates on the body.

The present invention relates to sealing apparatus for use downhole, an expanding material, a method of forming a downhole apparatus, and methods of use. The expanding material of the invention may be conveniently used in isolation tools and systems, in cased and uncased holes. The invention provides sealing mechanisms and isolation tools and systems which may be manufactured and assembled more efficiently than in the case of the prior art, and which are flexible in their application to a variety of wellbore scenarios.

The present invention recognises that a seal in a wellbore annulus can be formed from a multilayer structure formed from a substantially cured material, without a requirement of curing the layers on the body. The seal can be maintained even when the expanding portion and substantially cured material is exposed to wellbore pressure.

By creating a sealing arrangement from multiple layers of an expanding material, it may be easier to assemble the apparatus when compared with conventional slip-on apparatus. For example, the apparatus could be formed on a central 2 metre portion of a 12 metre casing section. The expanding material is economical to manufacture, compact to store, and easy to handle when compared with the materials used in conventional swellable packers.

The process of forming the packer offers several advantages. Firstly, the process does not require specialised equipment requiring large amounts of space or capital expenditure. The process can be carried out from a central portion of the tubular body, by attaching a first end of the expanding material and coiling it around the tubular, reducing the difficulties associated with slipping tool elements on at an end of the tubular and sliding them to the required location. This facilitates application of the expanding material to significantly longer tubulars, and opens up the possibility of constructed packer on strings of tubing on the rig floor immediately prior to or during assembly. The construction process allows for a high degree of flexibility in tool design. For example, a packer of any desired outer diameter can be created from the same set of components, simply by adjusting the number of layers of the expanding material that are wrapped on the tubular body. Packers and seals can be created on bodies and tubulars of a range of diameters. The principles of the invention also inherently allow for engineering tolerances in the dimensions of bodies on which the seal is created.

The resulting packers may have increased surface area with respect to an equivalent packer with an annular mantle by virtue of fluid flow paths being created between the multiple layers, allowing for faster expansion to the sealing condition. The expanding material also lends itself well to post-processing, for example perforating, coating or performing analysis on a sample.

The use of a substrate or a material with different mechanical characteristics in the expanding material allows more tension to be applied and retained in the expanding material during the construction process, and reduces any tendency of the expanding material to swage. It also binds to the swellable material, and resists expansion of the expanding material in a longitudinal direction.

The invention can be used to create a seal in the annulus around a continuous path from region to above the seal to a region below the seal, via a conduit encapsulated by the expanding material. For example, the path is a hydraulic line for the supply of hydraulic fluids. In other embodiments, this conduit can be used for the deployment of fluids, cables, fibre optics, hydraulic lines, or other control or data lines across the seal. One specific application of the invention is to artificial lift systems using electric submersible pumps (ESPs).

It will be appreciated by one skilled in the art that the invention is applicable to packers formed tubulars, mandrels, or packing tools which are run on a wireline. In addition, the present invention has application to which extends beyond conventional packers. The invention may be particularly valuable when applied to couplings and joints on tubulars and mandrels. The invention can also be applied to coiled tubing, for use in coiled tubing drilling or intervention operations.

Variations to the above described embodiments and are within the scope of the invention, and combinations other than those explicitly claimed form part of the invention. Unless the context requires otherwise, the physical dimensions, shapes, internal profiles, end rings, and principles of construction described herein are interchangeable and may be combined within the scope of the invention. For example, any of the described internal profiles of expanding material may be used with the described external profiles. The principles of construction described above may apply to any of the described profiles, for example, the described bonding method or the heat curing method may be used with any of the expanding materials described. Additionally, although the invention is particularly suited to downhole use it may also be used in topside and subsea applications such as in pipeline systems. It may also be used in river crossing applications.

What is claimed is:

1. A method of forming an apparatus for use downhole, the method comprising the steps of:

providing a body having a longitudinal axis; and forming an expanding portion on the body by sequentially wrapping multiple layers of a substantially cured material around the longitudinal axis of the body, the material selected to expand on exposure to at least one predetermined fluid.

2. The method as claimed in claim 1, further comprising the step of bonding the substantially cured material on the body.

3. The method as claimed in claim 1, further comprising the step of mechanically attaching the expanding portion to the body.

4. The method as claimed in claim 1, wherein the expanding portion is formed from a continuous length of the substantially cured material.

5. The method as claimed in claim 1, further comprising the step of forming a base layer on the body and forming the expanding portion on the base layer.

6. The method as claimed in claim 1, further comprising the step of providing an outer sheath on the expanding portion.

7. The method as claimed in claim 1, further comprising the step of treating the substantially cured material prior to forming the expanding portion.

8. The method as claimed in claim 1, further comprising the step of applying a coating to the substantially cured material.

9. The method as claimed in claim 1, further comprising the step of perforating the material.

10. The method as claimed in claim 1, further comprising the step of deploying the material from a storage reel.

11. The method as claimed in claim 1, wherein the substantially cured material is an elastomer in a T50 state or above, where T100 is the fully cured state of the elastomer.

12. The method as claimed in claim 1, wherein the substantially cured material is an elastomer in a T80 state or above, where T100 is the fully cured state of the elastomer.

13. The method as claimed in claim 1, wherein the substantially cured material is an elastomer in a T90 state or above, where T100 is the fully cured state of the elastomer.

14. The method as claimed in claim 1, further comprising the step of further curing the material after forming the expanding portion on the body.

15. An apparatus comprising:

a body having a longitudinal axis;

an expanding portion formed around the longitudinal axis of the body from multiple layers of a substantially cured material, sequentially wrapped on the body, wherein the material is configured to expand on exposure to at least one predetermined fluid.

16. The apparatus as claimed in claim 15, wherein the substantially cured material is an elastomer in a T50 state or above, where T100 is the fully cured state of the elastomer.

17. The apparatus as claimed in claim 15, wherein the substantially cured material is an elastomer in a T80 state or above, where T100 is the fully cured state of the elastomer.

18. The apparatus as claimed in claim 15, wherein the substantially cured material is an elastomer in a T90 state or above, where T100 is the fully cured state of the elastomer.

19. The apparatus as claimed in claim 15, wherein the substantially cured material comprises a material selected to expand on exposure to a hydrocarbon fluid.

20. The apparatus as claimed in claim 15, wherein the substantially cured material comprises a material selected to expand on exposure to an aqueous fluid.

21. The apparatus as claimed in claim 15, wherein the substantially cured material is formed by an extrusion process.

22. The apparatus as claimed in claim 21, wherein the substantially cured material is formed by a co-extrusion of two or more materials.

23. The apparatus as claimed in claim 15, wherein the substantially cured material comprises an interlocking profile, configured for interlocking multiple layers of the material on the body.

24. The apparatus as claimed in claim 15, further comprising a mechanical attachment for securing the substantially cured material to the body.

25. The apparatus as claimed in claim 15, wherein the substantially cured material comprises a coating.

26. The apparatus as claimed in claim 15, wherein the substantially cured material comprises perforations.

27. The apparatus as claimed in claim 15, further comprising a support element disposed between the body and the substantially cured material.

28. The apparatus as claimed in claim 27, wherein the support element defines a passage for a conduit or cable through the apparatus.

29. The apparatus as claimed in claim 15, wherein the apparatus is part of a wellbore packer.

30. A method of forming an apparatus for use downhole, the method comprising the steps of:

providing a body having a longitudinal axis;

forming an expanding portion on the body by sequentially wrapping multiple layers of a partially cured material around the longitudinal axis of the body, the material selected to expand on exposure to at least one predetermined fluid.

31. The method as claimed in claim 30, wherein the partially cured material is preferably an elastomer in a cured state in the range of T30 to T50, where T100 is the fully cured state of the elastomer.

32. The method as claimed in claim 31, further comprising the step of further curing the material subsequent to forming the expanding portion.

33. An apparatus for use downhole, the apparatus comprising:

a body having a longitudinal axis;

an expanding portion formed on the body from multiple layers of a partially cured material sequentially wrapped around the longitudinal axis of the body, the material selected to expand on exposure to at least one predetermined fluid.

34. The apparatus as claimed in claim 33, wherein the material is partially cured such that it is in a cured state in the range of T30 to T50, where T100 is the fully cured state of the elastomer.

35. The apparatus as claimed in claim 33, wherein the apparatus is part of a wellbore packer.

* * * * *

UNITED STATES PATENT AND TRADEMARK OFFICE

CERTIFICATE OF CORRECTION

PATENT NO. : 8,464,800 B2
APPLICATION NO. : 12/393960
DATED : June 18, 2013
INVENTOR(S) : Kim Nutley et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 204 days.

Signed and Sealed this
Sixteenth Day of December, 2014

Michelle K. Lee

Michelle K. Lee
*Deputy Director of the United States Patent and Trademark Office*